US008408947B2

(12) United States Patent
Lorenzo Riera et al.

(10) Patent No.: US 8,408,947 B2
(45) Date of Patent: Apr. 2, 2013

(54) ELECTRIC CONNECTOR ASSEMBLY

(75) Inventors: Miguel Angel Lorenzo Riera, Sant Climent de Lllobregat (ES); Juan José Verdú Martínez, Sant Climent de Lllobregat (ES)

(73) Assignee: Industrias Lorenzo, S.A., Sant Climent de Lllobregat, Barcelona (ES)

( * ) Notice: Subject to any disclaimer, the term of this patent is extended or adjusted under 35 U.S.C. 154(b) by 0 days.

(21) Appl. No.: 13/273,164

(22) Filed: Oct. 13, 2011

(65) Prior Publication Data

US 2012/0094545 A1 Apr. 19, 2012

(30) Foreign Application Priority Data

Oct. 13, 2010 (EP) ..... 10380127

(51) Int. Cl.
*H01R 13/514* (2006.01)

(52) U.S. Cl. ..... 439/701

(58) Field of Classification Search ..... 439/701, 439/685, 686, 855, 854
See application file for complete search history.

(56) References Cited

U.S. PATENT DOCUMENTS

| | | | | |
|---|---|---|---|---|
| 5,314,354 | A * | 5/1994 | Nomura et al. | 439/620.27 |
| 5,543,594 | A | 8/1996 | Romero-Herrera | |
| 6,695,632 | B2 * | 2/2004 | Matsumoto et al. | 439/246 |
| 6,855,007 | B2 | 2/2005 | Irish | |

* cited by examiner

*Primary Examiner* — Tulsidas C Patel
*Assistant Examiner* — Phuongchi Nguyen
(74) *Attorney, Agent, or Firm* — Hess Patent Law Firm LLC; Robert J. Hess

(57) ABSTRACT

An electrical connector assembly includes a casing (40, 50) formed by a base body (10) and a complementary body (20, 30), which are mutually coupled by releasable fixing devices. The base body (10) has channels (12) and at least one first channel part (12*a*), and openings (11) in communication with the channels (12) and the first channel part (12*a*). The complementary body (20, 30) has a second channel part (12*b*) complementing the first channel part (12*a*) to together form another channel when the base body (10) and complementary body (20, 30) are mutually coupled. Terminals (7*a*) connected to conductor wires (8*a*) are inserted in the channels (12; 12*a*, 12*b*). Contact tabs (9*a*) of an electrical device (60, 70) are connected with the terminals (7*a*) when said contact tabs (9*a*) are inserted in the openings (11) of the casing (40, 50).

6 Claims, 3 Drawing Sheets

ELECTRIC CONNECTOR ASSEMBLY

TECHNICAL FIELD

The present invention generally relates to an electrical connector assembly and more particularly to an electrical connector assembly to be used with a plurality of conductor wires and an electrical device.

STATE OF THE PRIOR ART

Various electrical connector assemblies are already known which have a body with a configuration and elements suitable for connecting to them, on one hand, conductors coming from an electric circuit and coupling to them, on the other hand, an electrical device such as a lamp socket assembly or an electrical switch or microswitch.

A well known case is the typical push-button switch with a small built-in lamp such as the one described in document U.S. Pat. No. 5,543,594 which essentially comprises a connecting block having a miniature push-button type electrical switch with a small built-in lamp, which comprises a push-button with a translucent cover and a housing in which said push-button is seated. A tubular part of the housing is externally threaded for coupling a nut to the switch. A pushing member is fixed to the button for the purpose of acting on the microswitch. At the opposite part of the push-button there are pins or terminals for the connection thereof to suitable conductor wires.

The mentioned device therefore has an exclusive and very specific application to a small built-in lamp in a push-button type switch.

Document ES-A-2237335 is also known, which describes a connector for connecting a plurality of conductor wires to a miniature lamp socket and switch assembly, which is similar to the one described in the mentioned document U.S. Pat. No. 5,543,594, and which has contact tabs and a grounding pin. The connector includes a molded one-piece casing and a plurality of terminals for attaching the plurality of conductor wires to the contact tabs and the grounding pin. A plurality of openings are formed inside the casing, accepting the plurality of terminals as well as the contact tabs and the grounding pin of the assembly, and allowing the terminals to be connected to the contact tabs and the grounding pin. The plurality of openings are formed on the lower, front and rear faces of the casing. This document also describes a method for connecting a miniature lamp socket and switch assembly, which is similar to the one described in the mentioned document U.S. Pat. No. 5,543,594 and which comprises contact tabs and a grounding pin to a plurality of conductor wires.

The device which has just been described has a very specific field of application, namely, a small lamp socket associated with a miniature switch or microswitch.

DISCLOSURE OF THE INVENTION

The present invention provides an electrical connector assembly to be used with a plurality of conductor wires and an electrical component having a plurality of contact tabs. Said connector assembly comprises a casing which is formed by a base body and a complementary body which are mutually coupled. The base body comprises parallel first channels in which there are housed a plurality of terminals fixed to said plurality of conductor wires, and a plurality of openings formed in the base body in communication with said first channels and arranged to receive said contact tabs, such that the contact tabs are connected with said terminals when they are inserted into said openings. At least one of the mentioned first channels is configured from a first channel part formed in the base body and a second channel part formed in said complementary body, such that said first and second channel parts complement one another to form together the first channel when said base body and complementary body are mutually coupled.

The base body and the complementary body are preferably coupled to one another by releasable fixing means comprising guide members, positioning members and retaining members formed in the base body and in the complementary body, respectively. In one embodiment, said guide members comprise at least one guide groove formed in one of the base body and complementary body and at least one guide flange formed in the other one of the base body and complementary body. The mentioned guide groove and guide flange are mutually coupled and cooperate to allow a relative sliding of the base body and complementary body in a direction parallel to the first channels.

The mentioned positioning members comprise, for example, respective stop surfaces positioned to make mutual contact when the base body and complementary body are in a predetermined relative position, and the retaining members comprise, for example, a protrusion in the form of a hook projecting from an elastic arm formed in one of the base body and complementary body and configured to be locked by elastic deformation and recovery of said arm in a recessed step formed in the other one of the base body and complementary body when both are slid with respect to one another and reach said predetermined relative position.

An advantage of the electrical connector assembly of the present invention is that it can include a variety of different complementary bodies adapted for different functions, which can be individually coupled to the base body to form different connector casings adapted to different uses.

For example, in a first embodiment the complementary body can include, in addition to the corresponding releasable fixing means, only the second channel part for complementing the first channel part formed in the base body for the purpose of forming a complete channel in the casing. The resulting connector casing is useful, for example, for connecting an electrical device such as a miniature switch or microswitch to a plurality of conductor wires.

In a second alternative embodiment, the complementary body can include, in addition to the corresponding releasable fixing means and the second channel part, one or more second channels in communication with one or more corresponding second openings, where said second channels are configured to receive corresponding terminals connected to conductor wires and said second openings are arranged to receive corresponding contact tabs of said electrical device such that the contact tabs are connected to said terminals when they are inserted into the second openings. The second channels of the second body are preferably parallel to the first channels of the base body and are located at a different level, and said second openings of the second body are separated from said first openings of the base body and located at a different level when the base body and complementary body are mutually coupled in said predetermined relative position.

The connector casing of this second embodiment is useful, for example, for connecting an electrical device such as an assembly formed by a miniature switch or microswitch and a lamp socket equipped with a small lamp similar to the one described in the mentioned document U.S. Pat. No. 5,543,594.

Therefore, the electrical connector assembly of the present invention is more versatile than those known in the prior art, because while the latter, and particularly the connector described in the mentioned document ES-A-2237335, which has a molded one-piece casing, are configured to invariably receive a small lamp with a push-button switch or a socket for a small lamp and switch, respectively, the electrical connector assembly of the present invention allows forming several different casings by coupling a base body and a complementary body selected from a plurality of different complementary bodies to receive different electrical devices, for example a switch, a lamp socket, or a lamp socket and switch assembly, among others.

BRIEF DESCRIPTION OF THE DRAWINGS

The previous and other features and advantages will be more fully understood from the following detailed description of several embodiments with reference to the attached drawings in which.

DETAILED DESCRIPTION OF EXEMPLARY EMBODIMENTS

Figure 2:
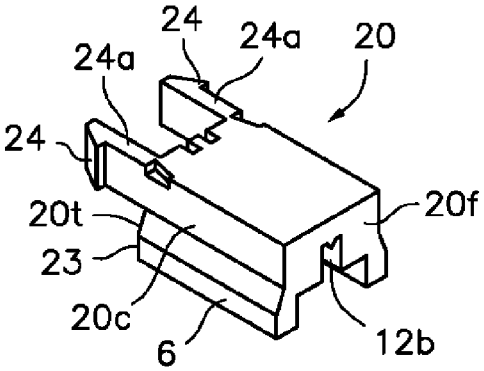
FIG. 2 is a perspective view of a second body which, together with the first body of FIG. 1, forms the casing of the electrical connector assembly according to the first embodiment.
Figure 3:
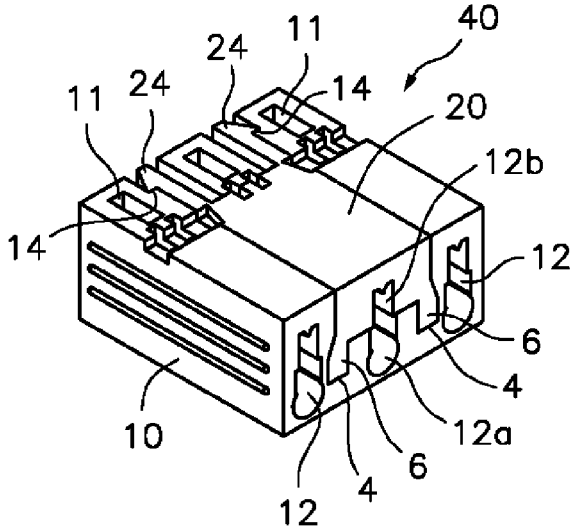
FIG. 3 is a perspective view of the first and second bodies of FIGS. 1 and 2 mutually coupled to form the casing of the electrical connector assembly of the first embodiment.
Figure 4:
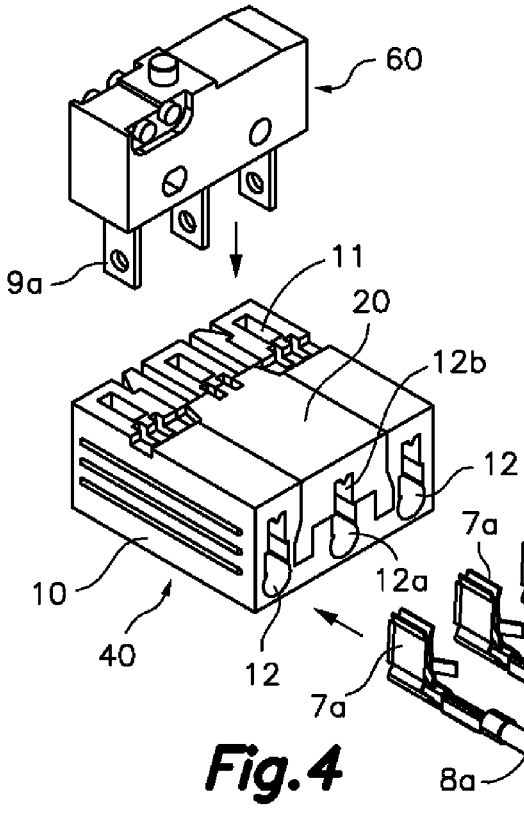
FIG. 4 is an exploded perspective view of the casing of FIG. 3, conductor wires and a microswitch to be connected to the conductor wires.
Figure 5:
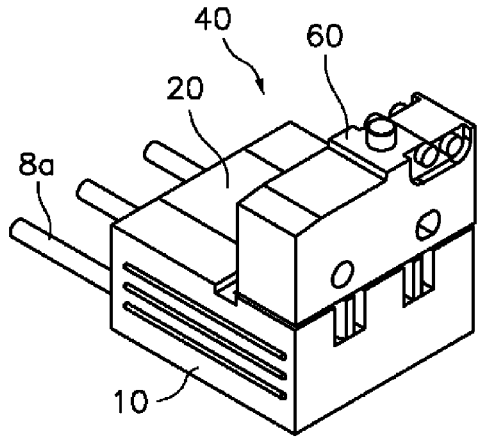
FIG. 5 is a perspective view of the casing of FIG. 3 and the microswitch coupled thereto, shown from a reverse point of view.

FIGS. 4 and 5 show an electrical connector assembly according to a first embodiment of the present invention, being used with a plurality of conductor wires 8*a* and an electrical device such as a miniature switch or microswitch 60. This electrical connector assembly of the first embodiment comprises a casing 40 (shown in FIG. 3), which is formed by a base body 10 (shown in FIG. 1) and a first complementary body 20 (shown in FIG. 2) which are coupled to one another. The base body 10 and first complementary body 20 are obtained by molding an electrically insulating plastic material.

Figure 6:
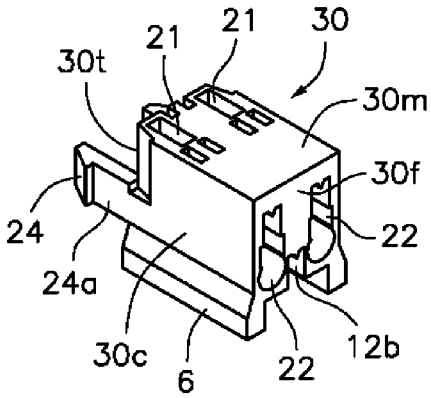
FIG. 6 is a perspective view of another second body which, together with the first body of FIG. 1, forms the casing of the electrical connector assembly according to a second embodiment.
Figure 7:
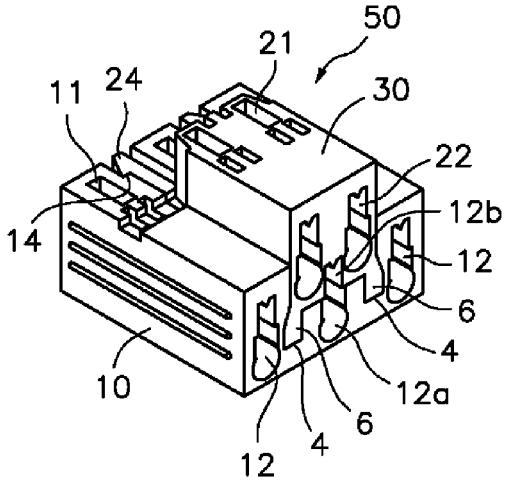
FIG. 7 is a perspective view of the first and second bodies of FIGS. 1 and 6 mutually coupled to form the casing of the electrical connector assembly of the second embodiment.
Figure 8:
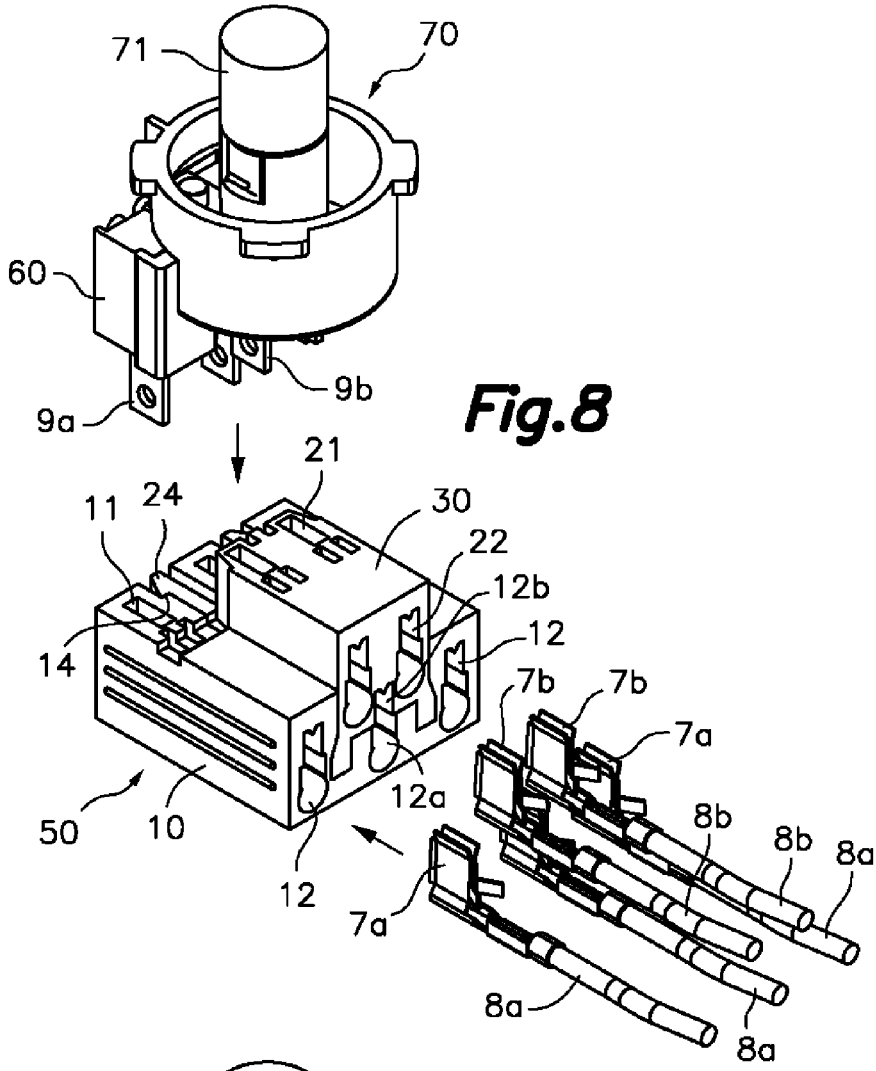
FIG. 8 is an exploded perspective view of the casing of FIG. 3, conductor wires and a microswitch, socket and lamp assembly to be connected to the conductor wires.
Figure 9:
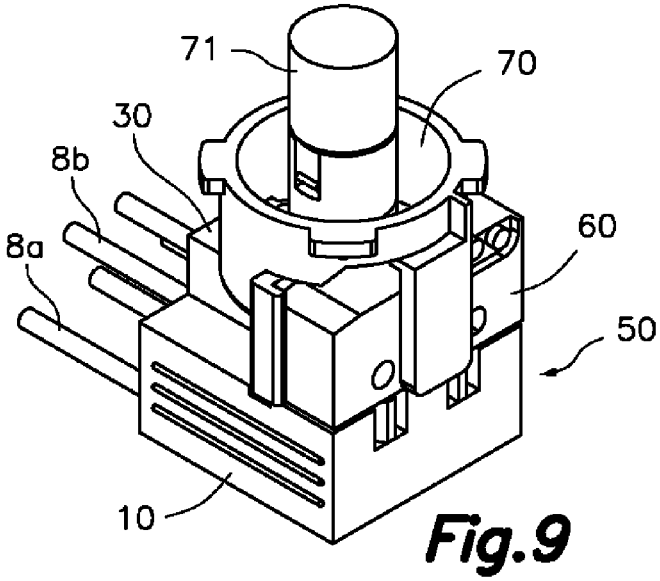
FIG. 9 is a perspective view of the casing of FIG. 3 and the microswitch, socket and lamp assembly coupled thereto, shown from a reverse point of view.

FIGS. 8 and 9 show an electrical connector assembly according to a second embodiment of the present invention, being used with a plurality of conductor wires 8*a* and an electrical device such as an assembly formed by a miniature switch or microswitch 60 and a lamp socket 70 equipped with a small lamp 71. This electrical connector assembly of the second embodiment comprises a casing 50 (shown in FIG. 7), which is formed by the same base body 10 (shown in FIG. 1) and another second complementary body 30 (shown in FIG. 6) which are coupled to one another. Said second complementary body 30 is also obtained by molding an electrically insulating plastic material.

Figure 1:
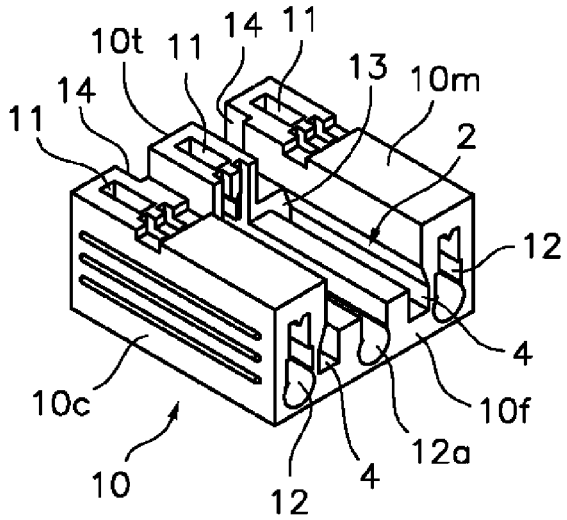
FIG. 1 is a perspective view of a first body which, together with a second body, forms a casing of an electrical connector assembly according to first and second embodiments of the present invention.

The base body 10 has a substantially parallelepiped configuration, with an upper face 10*m*, two side faces 10*c*, a front face 10*f* and a rear face 10*t* (according to the orientation shown in FIG. 1). On said upper face 10*m* there is a central recess 2 having an inlet through the front face 10*f* of the base body 10, but it does not reach the rear face 10*t* thereof. On both sides of the mentioned central recess 2 there are respective channels 12 with an inlet through said front face 10*f*. Close to the rear face 10*t* of the base body 10 there are openings 11 with an inlet through the upper face 10*m*, and which are communicated with the channels 12. On the front face 10*f* of the base body 10, in a central region of the mentioned recess 2, there is a first channel part 12*a* similar to the lower half of the channels 12, and on both sides of said first channel part 12*a* there are respective guide grooves 4 with an inlet on the front face 10*f* and which reach up to a first stop surface 13. The central recess 2 has prolongations on both sides of the central opening 11 reaching up to the rear face 10*t* of the base body 10, where it forms respective recessed steps 14.

The first complementary body 20 of the first embodiment (FIG. 2) and the second complementary body 30 of the second embodiment (FIG. 6) have in common an approximately parallelepiped configuration, of a size smaller than the base body 10, on the lower face of which (according to the orientation shown in FIGS. 2 and 6) they have formed a second channel part 12*b* similar to the upper half of the first channels 12 of the base body 10. Along side faces 20*c*, 30*c* of the first and second complementary bodies 20, 30 there are guide flanges 6 cooperating with the guide grooves 4 of the base body 10 to allow a relative sliding in a direction parallel to the channels 12 whereas they do not allow movements in other directions due to a special configuration thereof. The first and second complementary bodies 20, 30 comprise a second stop surface 23 on their rear faces 20*t*, 30*t* which makes contact with the corresponding first stop surface 13 of the base body 10 when the base body 10 and any one of the first and second complementary bodies 20, 30 are in a predetermined relative position.

The first and second complementary bodies 20, 30 of the first and second embodiments further have in common elastic arms 24*a* projecting backwardly from their rear faces 20*t*, 30*t*. These elastic arms 24*a* are finished in corresponding protrusions 24 directed outwardly in the form of hooks. Thus, when any one of the first and second complementary bodies 20, 30 is slid with respect to the base body 10 until reaching the mentioned predetermined relative position, the elastic arms experience an elastic deformation and recovery and the protrusions 24 are locked in the mentioned recessed steps 14 of the base body 10, thus retaining the first or second complementary body 20, 30 coupled to the base body 10.

As shown in FIGS. 3 and 7, when the base body 10 and the corresponding first or second complementary body 20, 30 are in the coupled position, the first channel part 12*a* of the base body 10 and the second channel part 12*b* of the first or second complementary body 20, 30 complement one another to form a central channel 12 which is communicated with that of said openings 11 formed on the larger face 10*m* of the first body located in the central position.

The first complementary body 20 of the first embodiment (FIG. 2) does not have more elements than the common elements described above. Thus, the mentioned casing 40 of the first embodiment (shown in FIG. 3), which is formed by the base body 10 (FIG. 1) and the first complementary body 20 (FIG. 2) coupled to one another, comprises three channels 12 with an inlet on the front face and which are communicated with three openings 11 with an inlet on the upper face, where the central channel is formed by the first and second channel parts 12*a*, 12*b* of the base body 10 and first complementary body 20 which are mutually coupled.

FIG. 4 illustrates the casing 40 of the first embodiment (FIG. 3), being used to connect an electrical device such as a miniature switch or microswitch 60 and a plurality of conductor wires 8*a*. Each conductor wire is connected to a terminal 7*a*, and when the conductor wires 8*a* and their terminals 7*a* are inserted into the corresponding channels 12; 12*a*, 12*b*, the terminals 7*a* face the corresponding opening 11. The mentioned microswitch 60 has contact tabs 9*a* which, when the microswitch 60 is coupled to the casing 40 of the first embodiment, are inserted into the openings 11 of the base body 10 and are connected with the corresponding terminals 7*a*, with the result shown from a reverse point of view in FIG. 5.

The second complementary body 30 of the second embodiment (FIG. 6) has, in addition to the common elements described above, a protruding upper part in which there are formed second channels 22 with an inlet on the front face 30*f* and which are communicated with second openings 21 with an inlet on the upper face 30*m*.

Thus, the casing 50 of the second embodiment shown in FIG. 7, which is formed by the base body 10 (FIG. 1) and the second complementary body 30 (FIG. 6), comprises three first channels 12 at a lower level and two second channels 22 parallel to the first channels 12 of the base body 10 and located at an upper level (according to the orientation shown in FIG. 7). The three first channels 12 of the lower level have an inlet on the front face 10*f* of the base body 10 and are communicated with the three first openings 11 with an inlet on the upper face 10*m* of the base body 10, where the central channel of the first channels is formed by the first and second channel parts 12*a*, 12*b* of the base body 10 and complementary body 30. The two second channels 22 of the upper level have an inlet on the front face 30*f* of the second complementary body 30 and are communicated with the two second openings 21 with an inlet on the upper face of the second complementary body 30.

FIG. 8 illustrates the mentioned casing 50 of the second embodiment (FIG. 7), being used to connect an electrical device, such as an assembly formed by a microswitch 60 and a lamp socket 70 having a small lamp 71 to first and second conductor wires 8*a*, 8*b*. The mentioned microswitch 60 has first contact tabs 9*a* located at a lower level (according to the orientation shown in FIG. 8) which must be connected to said first conductor wires 8*a* and the lamp socket 70 has second contact tabs 9*b* located at an upper level which must be connected to said second conductor wires 8*b*. Each first conductor wire 8*a* is connected to a first terminal 7*a* and each second conductor wire 8*b* is connected to a second terminal 7*b*.

When the three first conductor wires 8*a* and their respective first terminals 7*a* are inserted into the corresponding first channels 12; 12*a*, 12*b* of the lower level, the first terminals 7*a* face the corresponding first openings 11 of the base body 10, and when the two second conductor wires 8*b* and their respective second terminals 7*b* are inserted into the channels 22 of the upper level, the second terminals 7*b* face the corresponding openings 21 of the second complementary body 30.

Thus, when the electrical device formed by the microswitch 60 and lamp socket 70 assembly is coupled to the casing 50 of the second embodiment, the first contact tabs 9*a* of the microswitch 60 are inserted into the first openings 11 of the base body 10 and are connected with the corresponding first terminals 7*a* whereas the second contact tabs 9*b* of the lamp socket 70 are inserted into the second openings 21 of the second complementary body 30 and are connected with the corresponding second terminals 7*b*, with the result shown from a reverse point of view in FIG. 9.

An advantage of the electrical connector assembly of the present invention lies in the fact that it can combine one and the same base body 10 with any one of the second bodies 20 or 30 according to the electrical device which is to be connected.

A person skilled in the art will be able to introduce changes, modifications and combinations in the embodiments described without departing from the scope of the present invention as it is defined in the attached claims.

What is claimed is:

1. An electrical connector assembly to be used with a plurality of conductor wires (8*a*) and an electrical device (60, 70) having a plurality of contact tabs (9*a*), said connector assembly comprising a casing (40, 50) which comprises a base body (10), parallel first channels (12) formed in said base body (10) and in which there are housed a plurality of terminals (7*a*) fixed respectively to said plurality of conductor wires (8*a*), and a plurality of openings (11) formed in the base body (10) in communication with said first channels (12) and arranged to receive said contact tabs (9*a*), such that the contact tabs (9*a*) are connected with said terminals (7*a*) when they are inserted into said openings (11), at least one of the first channels (12) being configured from a first channel part (12*a*) formed in the base body (10) and a second channel part (12*b*) formed in a complementary body (20, 30) coupled to said base body (10), said first and second channel parts (12*a*, 12*b*) complementing one another to form together the first channel (12) when said base body (10) and complementary body (20, 30) are mutually coupled, characterized in that said complementary body (30) comprises at least one second channel (22) in communication with a second opening (21), wherein said second channel (22) is configured to receive a terminal (7*b*) connected to a conductor wire (8*b*) and said second opening (21) is arranged to receive a contact tab (9*b*) of said electrical device (60, 70) such that the contact tab (9*b*) is connected to said terminal (7*b*).

2. The electrical connector assembly according to claim 1, characterized in that the second channel (22) of the complementary body (30) is parallel to the first channels (12) of the base body (10) and is located at a different level, and said second opening (21) of the second body (30) is separated from said first openings (11) of the base body (10) and located at a different level when the base body (10) and complementary body (30) are mutually coupled in said predetermined relative position.

3. The electrical connector assembly according to claim 1, characterized in that said base body (10) and complementary body (20, 30) are coupled by releasable fixing portions, which comprise guide members, positioning members and retaining members formed in the base body (10) and in the complementary body (20, 30), respectively.

4. The electrical connector assembly according to claim 3, characterized in that said guide members comprise at least one guide groove (4) formed in one of the base body (10) and complementary body (20, 30) and at least one guide flange (6)

formed in the other one of the base body (10) and complementary body (20, 30), wherein said guide groove (4) and guide flange (6) cooperate to allow a relative sliding of the base body (10) and complementary body (20, 30) in a direction parallel to the first channels (12).

5. The electrical connector assembly according to claim 4, characterized in that said positioning members comprise respective stop surfaces (13, 23) positioned to make mutual contact when the base body (10) and complementary body (20, 30) are in a predetermined relative position.

6. The electrical connector assembly according to claim 5, characterized in that said retaining members comprise a protrusion (24) projecting from an elastic arm (24*a*) formed in one of the base body (10) and complementary body (20, 30) and configured to be locked by elastic deformation and recovery in a recessed step (14) formed in the other one of the base body (10) and complementary body (20, 30) when both are in said predetermined relative position.

* * * * *